United States Patent [19]

Christopher

[11] Patent Number: 4,784,061

[45] Date of Patent: Nov. 15, 1988

[54] CAPSULE CHARGE LOCKING DEVICE

[75] Inventor: Glenn B. Christopher, Fort Worth, Tex.

[73] Assignee: Halliburton Company, Duncan, Okla.

[21] Appl. No.: 106,472

[22] Filed: Oct. 5, 1987

[51] Int. Cl.[4] ..... E21B 7/00

[52] U.S. Cl. ..... 102/306; 89/1.15; 102/476; 102/481

[58] Field of Search ..... 102/306-310, 102/331, 476, 481; 175/4.5, 4.6; 89/1.15

[56] References Cited

U.S. PATENT DOCUMENTS

| | | | |
|---|---|---|---|
| 2,494,256 | 1/1950 | Muskat et al. | 175/4.6 |
| 2,708,408 | 5/1955 | Sweetman | 89/1.15 |
| 2,742,857 | 4/1956 | Turechek | 89/1.15 |
| 2,750,884 | 6/1956 | Gaines | 175/4.6 |
| 2,764,938 | 10/1956 | Harcus | 175/4.6 |
| 2,799,224 | 7/1957 | Long | 175/4.6 |
| 2,960,930 | 11/1960 | Bell | 89/1.15 |
| 2,981,185 | 4/1961 | Caldwell | 175/4.53 |
| 3,048,101 | 8/1962 | Lebourg | 175/4.6 |
| 3,327,630 | 6/1967 | Bell | 102/310 |
| 3,670,828 | 6/1972 | Bennett | 175/4.6 |
| 3,991,836 | 11/1976 | Bouguyon et al. | 102/310 |
| 4,179,003 | 12/1979 | Cooper et al. | 384/94 |
| 4,273,047 | 6/1981 | Rommer | 102/310 |

FOREIGN PATENT DOCUMENTS

| | | | |
|---|---|---|---|
| 1070536 | 12/1959 | Fed. Rep. of Germany | 102/306 |
| 837900 | 6/1960 | United Kingdom | 102/306 |

*Primary Examiner*—Charles T. Jordan
*Assistant Examiner*—Michael J. Carone
*Attorney, Agent, or Firm*—Robert Hessin; Robert A. Kent

[57] ABSTRACT

A method and means for sealed joinder of case and cap members of a capsular shaped charge wherein mating grooves are formed in adjacent walls of a case and cap and a resilient O-ring is compressively retained therein to hold the case and cap in operative assembly to seal from external pressures and fluids while allowing relative rotation of case and cap; wherein increasing external pressures, as in the well bore, will increase the sealing effect and strength of joinder of the assembly.

11 Claims, 3 Drawing Sheets

CAPSULE CHARGE LOCKING DEVICE

BACKGROUND OF THE INVENTION

1. Field of the Invention

The present invention relates to capsular bodies for housing shaped charges and, more particularly, but not by way of limitation, it relates to an improved method and apparatus for sealing capsule members into an operative assembly.

2. Description of the Prior Art

Prior art forms of shaped charge as used for perforation of oil well casing and the like has taken a great many forms in the past. More recent developments have lead to the smaller, capsule-type shaped charges which can be utilized in suitable suspended arrays for downward insertion through well tubing or other narrow confines. One type of capsule shaped charge housing has consisted of a case for containing the shaped charge and a cap for secure positioning to enclose thereover, and the charge housing assembly is then held in tight closure by means of an adhesive. Still other types of capsule housing may include sealing O-rings, and the cap is then secured to the case by means of press-fit, threads, set screws or bonding agents, but in any event a rigid, secure, fluid-tight connection is made.

SUMMARY OF THE INVENTION

The present invention relates to an improvement in shaped charge capsule housings wherein the housing cap is maintained securely on the housing case by means of a compressed, resilient O-ring disposed in grooved seating between the cap and case side walls. Thus, the cap is reliably retained in position on the case to maintain the shaped charge in complete assembly while the case portion may be freely rotated relative to the cap member in order to accomodate threading of the detonator cord and facilitate the alignment of a plurality of such charges in a holder strip. In addition, the O-ring tends to extrude under increased external pressure as encountered down-hole to provide an increasingly tight seal.

Therefore, it is an object of the present invention to provide a capsule charge that is easy to assemble and relatively safer for transport and storage.

It is also an object of the present invention to provide a capsule charge that is more easily manipulated during alignment and arming of a series of charges on a holder strip.

It is yet another object of the invention to provide a charge capsule assembly that exhibits a proportionately greater sealing capability with increase of external pressure.

Finally, it is an object of the present invention to provide a capsule-type shaped charge that is easy to handle in use and with less likelihood of violent explosion during storage and transportation.

Other objects and advantages of the invention will be evident from the following detailed description when read in conjunction with the accompanying drawings which illustrate the invention.

DETAILED DESCRIPTION OF THE INVENTION

Figure 1:
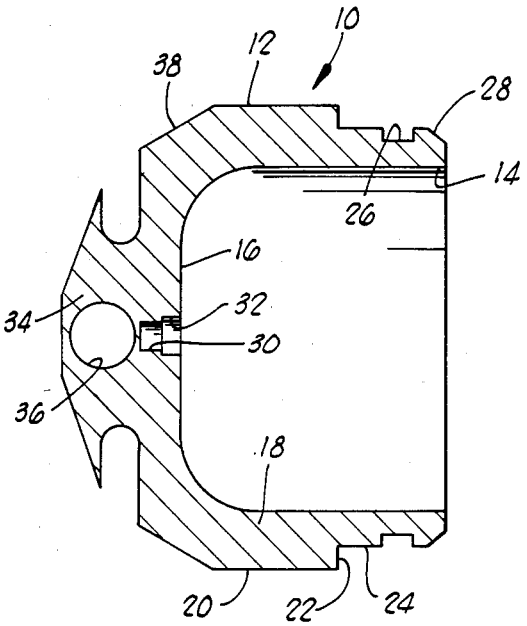
FIG. 1 is a vertical section of a capsule charge case member.

Referring to FIG. 1, a capsule charge case member 10 is formed generally as a cylinder 12 having an open end 14 and a closed end 16 the cylinder wall portion 12 is formed to have an inside wall 18 and an outside wall 20 which is formed through an annular shoulder 22 to provide a lesser diameter outer wall 24 adjacent open end 14. A rectangular groove 26 is formed circumferentially around cylinder wall 24 spaced from the open end 14 and a bevel edge 28 is formed circumferentially around end wall 29 at the terminus of cylinder wall 24.

A relatively small diameter bore 30 with a counter bore 32 is formed axially in closed end 16 to provide a small volume for holding booster charge. A vane formation 34 is formed to bisect the closed end 16 on the outer surface, and this vane includes an aperture 36 for receiving detonator cord therethrough. This type of capsule charge case member is generally known in the art, the departure being the formation of circumferential groove 26 proximate open end 14. The case member 10 may be formed from selected steel and finished with a flash zinc plate under clear chromate. Cylinder corners such as 38 are formed at an angle to enable the assembled capsule charge to be disposed within a minimum diameter measure, as will be further described below.

Figure 2:
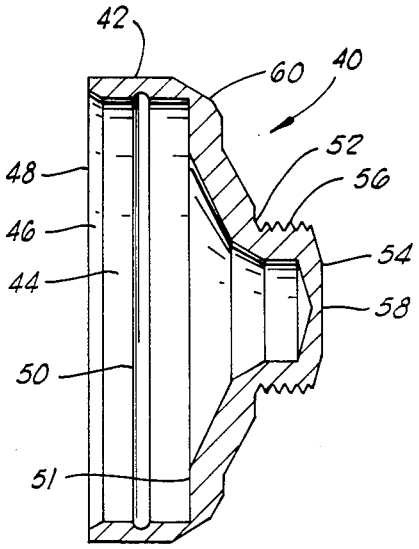
FIG. 2 is a vertical section of a capsule charge cap member.

FIG. 2 illustrates a cap member 40 which is formed as a body of revolution with a cylindrical side wall 42 having an inner wall 44 that terminates through a bevel 46 at open end wall 48. An arcuate groove 50, an arc slightly less than a semi-circle, is formed circumferentially around the inner wall 44 at selected spacing from end wall 48. An annular end wall 51 is formed around the inner surface of closed end 52 of case 40. The closed end 52 is formed generally as a conical member 54 merging into side wall 42 and being unitarily formed into a threaded boss portion 54. The boss portion 54 is round and includes threads 56, and a center portion 58 is formed as a thinnest point to receive explosive force puncture therethrough. Threads 56 are formed to allow threaded insertion of the capsule charge into a suitable holder strip. Here again, corners are rounded off to present such as shoulders 60 for the purpose of allowing clearance through a minimal diameter space.

Figure 3:
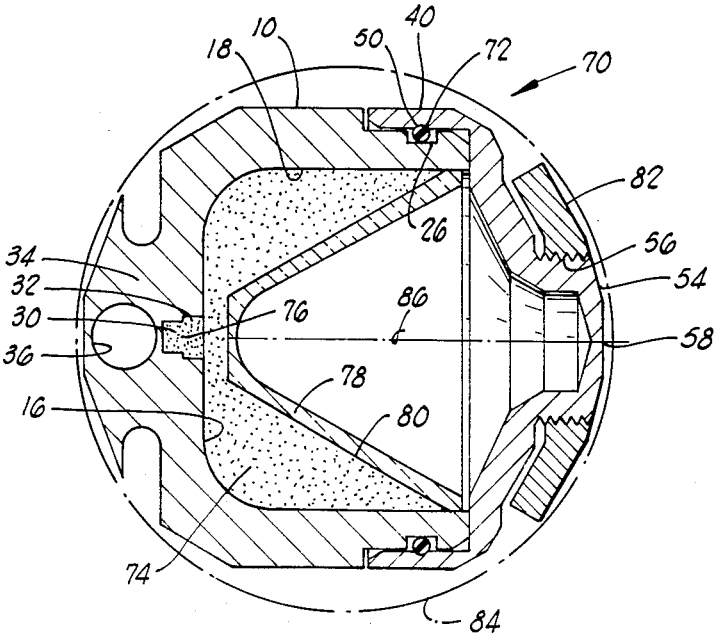
FIG. 3 is a vertical cross-section of an assembled capsule charge including the shaped charge material.

FIG. 3 illustrates a full capsule charge assembly 70 including the case 10 and cap 40 as assembled and secured by means of an O-ring 72 compressively seated within groove 26 and mating arcuate groove 50. A selected explosive charge 74, e.g. RDX Explosive, or other compressible high explosive material, is formed and inserted within inner side walls 18 adjacent rear wall 16. A selected booster explosive is placed in the counter bores 30, 32 which terminates adjacent aperture 36 and the detonator cord placed therein, e.g. PRIMACORD. Finally, a linear cone 78 is seated by means of a suitable bonding agent down within the conical surface 80 of the compressed explosive 74 thereby to complete the shaped charge.

The boss end 54 of cap 70 is then engaged by means of thread 56 within a suitable holder strip 82. The holder strip 82 may be of any selected length having a plurality of spaced holes for receiving charge insertion, the size and spacing depending on the exigencies of the particular shooting operation. It may be noted too that the holder strip 82 is arcuately shaped to maintain the circular outline so that the holder strip 82 plus shaped charge 70 may be clearly drawn through a selected size of tubing. The dash line 84 outlines a minimum diameter clearance relative to the capsule charge assembly and holder strip. Detonation of the charge tends to direct the explosive force jet along cylindrical axis 86 and through boss wall point 58 into whatever the adjacent structure or material.

In operation, no adhesive, threads or other bonding agent is required to secure the cap 40 over the open end of case 10. The O-ring 72 is compressively retained between mating grooves 26 and 50 to provide sufficient retentive grip to maintain the assembly in firm, fluid-tight affixure while also enabling some additional operational advantages, as will be further described.

One type of O-ring 72 that is suitable for use as a retention and sealing member is a compound C67 type consisting of peroxide cured nitrile as available from National O-Rings Division of Federal Mogul Corporation, Downey, Calif. This type of O-ring has a hardness of 88 durometer, tensile strength of 2825 psi, an elongation of about 90% and specific gravity of 1.29. Other similar O-rings constructed of lighter or heavier materials e.g. ethylenepropylene, or various VITON Types, may be used, depending upon the exigencies of the particular application. All such O-ring compound selections are available from National O-Rings, as identified above.

Figure 4A:
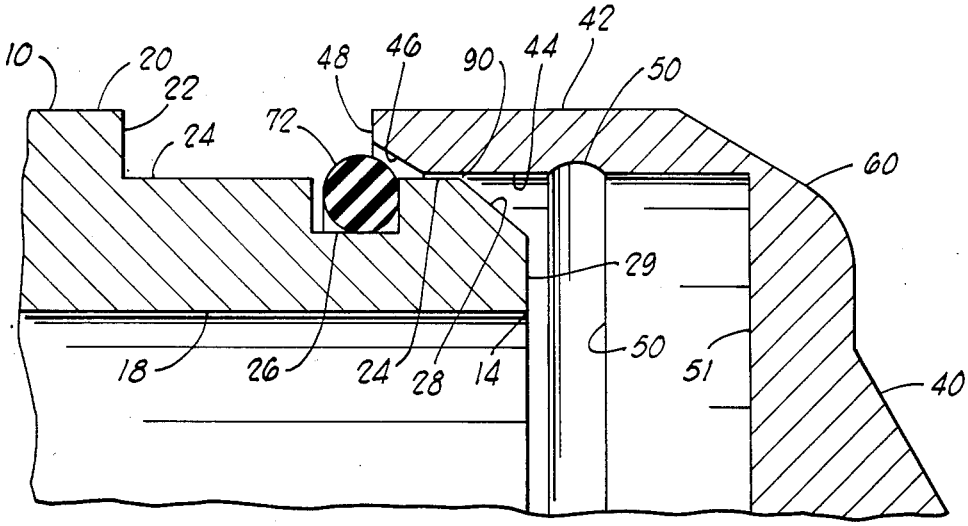
FIGS. 4A, 4B, 4C, and 4D are a vertical section of a portion of a capsule charge illustrating three different stages of assembly and the effects of high pressure on the O-ring of an assembled capsule charge.

Referring to FIG. 4A, the beginning of assembly of a case 10 and cap 40 shows positioning of the O-ring 72 in the rectangular groove 26 formed in the outer cylinder wall 24 of case 10. The cap 40 is then pushed over open end 14 with bevel edge 46 meeting and compressing O-ring 72 as the cap 40 is moved thereover into operative position. A small clearance 90 may be noted between cap inner wall 44 and the case outer cylindrical wall 24. This is a totally free, unbinding clearance of minimal dimension, i.e. easily slidable.

Figure 4B:
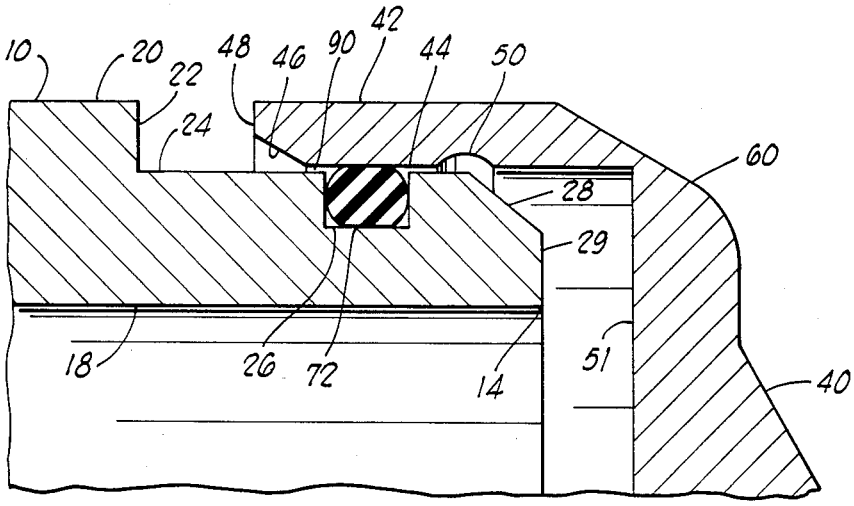
Figure 4C:
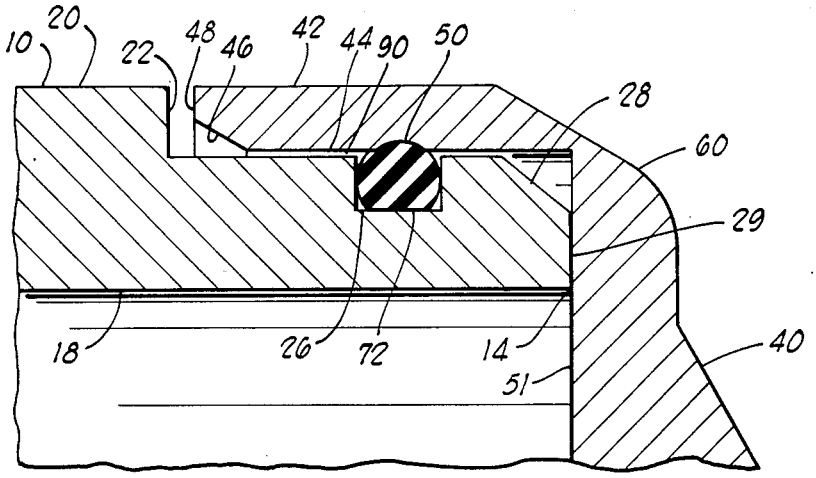

FIG. 4B then shows an intermediate assembly position wherein the bevel edge 46 of cap member 40 has been pressed entirely over O-ring 72 to hold it in a compressed state, and the minimal clearance 90 is maintained between the mating cylinder walls so that an easily sliding but nonconstricting or binding fit is achieved. FIG. 4C then proceeds to the full snap-fit engagement position wherein groove 50 is moved to super position over O-ring 72 which exerts an expansive force therein to provide sealing retention of the cap member 40 over open end 14 of case 10. In this operationally engaged attitude, the annular end wall 29 of case 10 is brought into abutment with rear annular wall 51 of cap 40.

The operational attitude of FIG. 4C has been found suitable for initial assembly and transportation of capsule charge units while also enabling easier handling and set-up in the field. That is, the O-ring seal snap-fit retention of case and cap is sufficiently strong for storage and transportation and actually provides a benefit as regards a degree of fire hazard. Due to the relatively loose coupling the charges may be transportable as a Class C explosive so that, in case of fire, the case and cap are easily separated so that the explosives contained therein will burn instead of exploding. Further, when setting up shots in the field, the threaded boss 54 is inserted in a holder strip 82 and then the case member 10 can be easily rotated while in sealing engagement to align the fuse aperture 36 in whatever orientation to easily receive a detonator cord.

Figure 4D:
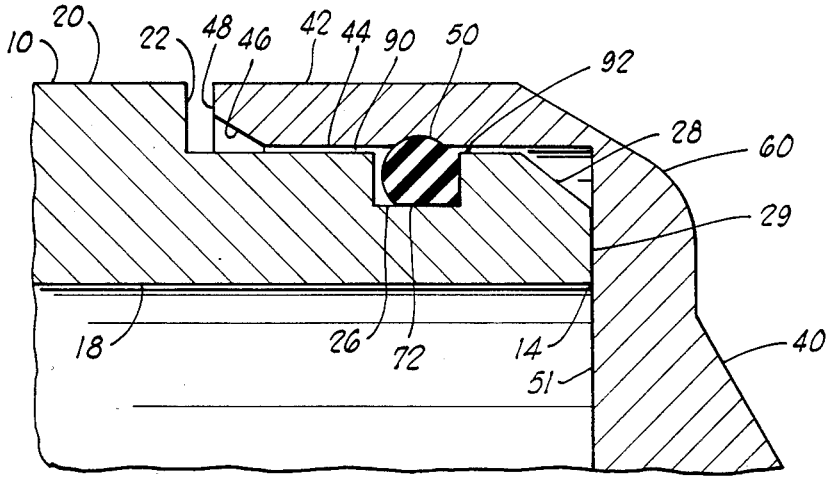

Yet another and a very important operational advantage is achieved during usage of the capsule charges in high pressure environments. Refer to FIG. 4D. As the capsule charges are lowered down into the high pressure depths of a well bore, the O-ring 72 tends to extrude under force of external pressure present via clearance 90 such that O-ring 72 extrudes and tightly seals as shown at flow point 92.

This extruded condition was borne out by means of a static pressure test as performed on a 2⅛ inch diameter capsule charge. Before subjection to pressure, it was found that seventy pounds force was required to pull the cap 40 from case 10 as retentively assembled with an O-ring 72. An identical type of capsule charge was then subjected to an external pressure of 15,000 PSI at 325° F. for a period of one hour. After the pressure test, the cap and case were still in uniform assembly and the case did not lead in any way; however, it required a force of 250 pounds to pull the cap 40 from the case 10 and the O-ring 72 was still in good condition albeit that it had been subjected to some extrusion.

Further safety testing in the nature of fire test was carried out on both 1 11/16 inch and 2⅛ inch capsule charges. Three 1 11/16 inch capsule charges were placed in a flaming fire environment for observance of behavior. In each case, the caps merely popped off from the cases and the enclosed explosive charge gassed off after elapsed times of approximately one minute and forty-five seconds. The caps were each found intact close by the test area.

Three additional larger charges of 2⅛ inch capsule charge were tested in like manner and observed from a safe vantage point. Here again, all three of the explosive charges had gassed off and all three caps were found intact i.e., non-destructed or exploded, and within a few feet of the original capsule charge placement. In addition, each of the cases still retained the liner cone as the explosive charge apparently gassed off with minimal disturbance of the cone members.

The foregoing discloses a novel means for retentively assembly case and cap of a capsule type shaped charge. Case and cap are maintained in operative, sealed assembly by the compressed O-ring, yet the capsule charge has enhanced operational features as well as increased safety in handling and transportation. While the invention has been described in relation to a capsule shaped charge of the perforator type, it should be understood that it may be utilized with tubing cutter charges and other types of explosive containers. It is a distinct advantage in any of many applications where an O-ring can provide sufficient grip to maintain assembly of an explosive container but will still allow gassing off of the explosive in the event of accidental ignition. It should be understood too that male/female joinder of case and cap open ends is a matter of design choice.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A shaped charge device, comprising:

a cylindrical metal case member having a closed end and an open end with a circumferential groove formed around the outer surface adjacent the open end;

a cylindrical metal cap member having a closed end and an open end that has a diameter of a size for mating engagement with the open end of said case member, and having a cap groove formed circumferentially about the inner surface adjacent the open end of the cap member and said open end having an angular bevel on the inner surface of said open end; and a resilent O-ring is compressively received within the case groove and the cap groove when said cap member is slidably positioned in mating engagement with said case member.

2. A device as set forth in claim 1 wherein:

said case groove is of rectangular shape.

3. A device as set forth in claim 2 wherein:

said cap groove is of arcuate cross section.

4. A device as set forth in claim 3 wherein:

said cap groove is arcuately formed in cross section and less than semi-circular.

5. A device as set forth in claim 1 wherein:

said cap groove is of arcuate cross section.

6. A device as set forth in claim 1 wherein:

said cap groove is arcuately formed in cross section and less than semi-circular.

7. A device as set forth in claim 1 wherein said case member comprises:

means formed on the closed end of said case member for receiving detonation of the shaped charge.

8. A device as set forth in claim 7 wherein:

said O-ring has a hardness of 88 on the durometer scale.

9. A device as set forth in claim 1 wherein said means for receiving comprises:

an axial hole formed in the closed end of the cylindrical case member immediately adjacent the shaped charge for containing a booster charge; and means for guiding a detonator adjacent said booster charge.

10. A device as set forth in claim 1 wherein said O-ring is formed of a cured nitrile of preselected hardness.

11. A method of assembling shaped charges of the type having a case member with an open end for containing a shaped charge and is placed in mating fluid-tight engagement with the open end of a cap member for receiving and directing the force from the shaped charge, comprising:

placing a resilient sealing ring under compressive deformation between the case member and the cap member adjacent walls so that the cap and case members are relatively rotatable, said sealing ring being snap-fit into mating grooves in the case and cap member adjacent walls such that a relatively loose but sealed joinder is effected for normal storage and handling but such sealed joinder is greatly strengthened under external pressure wherein increasing external pressure will cause extrusion of of the sealing ring and proportionately greater seal integrity.

* * * * *

UNITED STATES PATENT AND TRADEMARK OFFICE

CERTIFICATE OF CORRECTION

PATENT NO. : 4,784,061

DATED : November 15, 1988

INVENTOR(S) : Glenn B. Christopher

It is certified that error appears in the above-identified patent and that said Letters Patent is hereby corrected as shown below:

In column 4, line 25, the word "lead" should read --leak--.

Signed and Sealed this

Tenth Day of October, 1989

*Attest:*

*Attesting Officer*

DONALD J. QUIGG

*Commissioner of Patents and Trademarks*